US005490375A

United States Patent [19]

Špindler et al.

[11] Patent Number: 5,490,375

[45] Date of Patent: Feb. 13, 1996

[54] METHOD OF RESPINNING USING ANCILLARY YARN

[75] Inventors: Zdeněk Špindler; František Burýšek, both of Ústínad Orlicí ; Jiří Němec, Kostelec nad Orlieí ; Vojtěch Novotný, Ústí nad Orlicí ; Josef Lásko, Choceň ; Miroslav Blasel, Česká Třebová ; Oldřich Talacko, Žamberk, all of Czechoslovakia

[73] Assignee: Elitex USTI Nad Orlici, Usti nad Orlici, Czechoslovakia

[21] Appl. No.: 346,775

[22] Filed: Nov. 30, 1994

Related U.S. Application Data

[63] Continuation of Ser. No. 947,720, Sep. 18, 1993, Pat. No. 5,396,758.

[30] Foreign Application Priority Data

Sep. 23, 1991 [CS] Czechoslovakia ..... 2899-91

[51] Int. Cl.[6] ..... D01H 4/50; D01H 15/02

[52] U.S. Cl. ..... 57/263; 57/269; 57/278

[58] Field of Search ..... 57/263, 261, 269, 57/278, 279; 242/35.5 A

[56] References Cited

U.S. PATENT DOCUMENTS

| | | | |
|---|---|---|---|
| 3,962,855 | 6/1976 | Stahleckere | 57/34 R |
| 4,125,990 | 11/1978 | Stahlecker et al. | 57/263 |
| 4,539,803 | 9/1985 | Ferro et al. | 57/263 |
| 4,891,933 | 1/1990 | Raasch | 57/269 |
| 4,920,739 | 5/1990 | Raasch | 57/263 |
| 5,022,222 | 6/1991 | Rupert et al. | 57/263 |
| 5,396,758 | 3/1995 | Spindler et al. | 57/263 |

*Primary Examiner*—William Stryjewski
*Attorney, Agent, or Firm*—Notaro & Michalos

[57] ABSTRACT

The invention relates to a method of respinning-in in open-end spinning machines after a bobbin removal from the swinging arms (51, 52) of the bobbin holder (5) or at the beginning of spinning at an empty spinning station, and to a device for carrying out the method. During the fixing of the empty tube (8) between the swinging arms (51, 52) of the bobbin holder (5) at a spinning station at rest, an ancillary yarn (15) is inserted between a swinging arm (51) and the edge of the tube (8) and then gripped the swinging arm (51), then its opposite end is adapted for one spinning-in in an attending device (9) and spun-in, then is this ancillary yarn (15) together with the beginning of the newly spun yarn wound onto the tube (8) as yarn reserve, whereupon the yarn is handed over to the distributing mechanism of the machine for producing a cross-wound bobbin.

4 Claims, 2 Drawing Sheets

METHOD OF RESPINNING USING ANCILLARY YARN

This application is a continuation of Ser. No. 07/947,720, filed Sep. 19, 1993, now U.S. Pat. No. 5,396,758.

FIELD AND BACKGROUND OF THE INVENTION

The present invention relates to a method of respinning-in on open-end spinning machines after removing a fully wound bobbin from the swinging arms of a bobbin holder or prior to spinning at an empty spinning station, and to a device for carrying out the method.

Open-end spinning machines have undergone rapid development. They are automated to a considerable extent and are generally known to have attending devices which permit operation without human intervention. Up till now, three basic methods have been used during bobbin exchange with subsequent spinning-in, with some slight differences existing between each method.

A first method permits the bobbin exchange without interrupting the spinning process and consequently without any need for respinning. A new tube is inserted into the spinning machine while the operating station is running. During the bobbin exchange operation, the yarn is usually taken up or sucked off into a collector. When the bobbin exchange operation is finished, the sucked-off yarn is separated and applied to the new bobbin. This method has at least three drawbacks. First, there is a loss of the deviated yarn. Second, the method is not suitable for high delivery speeds because the mechanism carrying out the bobbin exchange is forced to work at high speeds undergoing considerable dynamic forces, with a resulting adverse effect on its service life. Third, this method is inapplicable to a standing operation unit, i.e., the beginning of a spinning cycle.

This third drawback, i.e., the problem arising at the beginning of a new spinning cycle, has been eliminated by a method in which at each bobbin exchange the spinning process is interrupted for a necessary time interval, so that the spinning unit can be cleaned prior to the respinning of the yarn. The yarn required for the respinning-in is obtained from wound yarn carried by a respective automative device. The bobbin exchange is the insertion of any empty tube into the machine arms which is carried out during the spinning operation similar to the first method. Therefore, this method has the same drawbacks of the first method.

For this reason, another method exists in which the spinning process of the operation unit in question is stopped or interrupted while the fully wound bobbin is being replaced by an empty tube. To permit the subsequent spinning-in and the automatic spinning resumption, a special mechanism provides a basic winding to the tube wherein the yarn is of a length sufficient enough for at least one spinning-in prior to the tube being fixed in the winding arms. This method permits the automative device to operate at very high delivery speeds since the bobbin exchange takes place with the operation station at rest and is therefore independent of the delivery speed.

Tests have shown that on a tube fitted with only a few initial windings of yarn, in particular on a perforated tube but to a lesser degree on a conical tube as well, the search for the yarn end carried out by the suction tube of the attending automatic device often causes disorder and irregular interlacing with other neighboring yarn windings, thus disturbing the spinning-in process and reducing the reliability of the bobbin exchange. Also, the spinning-in process has proved that it is impossible to create a spinning-in sector of yarn that is unnoticeable. There is always a detectable fault in the yarn appearance. Besides, the yarn used for the initial starting windings on the tube is not identical with the yarn just being produced at the operation unit or station in question. At first sight, these objections may appear trifling, but it is a fact that in goods such as knitwear, slight deviations in the yarn are visible faults. Moreover, the steadily increasing delivery speeds of the open-end spinning machines increase the desirability of carrying out the bobbin exchange with the operation unit at rest in order to avoid excessive requirements on the attending mechanisms, and to ensure at the same time that neither the initial (starting) windings nor the spun-in yarn sector are included into the finished products in the subsequent operations.

SUMMARY OF THE INVENTION

The drawbacks of the background art are eliminated by a method of respinning-in on open-end spinning machines according to the present invention. The present invention provides that during the fixing of an empty tube between the swinging arms of a bobbin holder at a spinning station which is at rest, an ancillary yarn is inserted between a swinging arm and the edge of the tube and then gripped by the swinging arm. The opposite end of the ancillary yarn is adapted for one spinning-in in an attending device and then spun-in. Then the ancillary yarn is wound onto the tube together with the beginning of the newly spun yarn to form a yarn reserve. The yarn is then handed over to a distributing mechanism of the machine for producing a cross-wound cone.

The present invention provides for an attending device which comprises a rotatably mounted tube transport arm having at its extremity a tube gripping device. A swinging arm is rotatably mounted to the transport arm. The swinging arm has a device for griping the ancillary yarn. This device has a suction hole for taking in the ancillary yarn. When the device is in an ancillary yarn gripping position, the suction hole lies opposite a device for holding the ancillary yarn. When in a transport position, the suction hole is positioned at an end of the tube. A spinning-in head is located on a spinning-in lever. The lever is rotatably mounted to the body of the attending device and at its extremity the head engages the ancillary yarn for producing and adapting for spinning-in the ancillary yarn end.

The present invention eliminates the drawbacks in the method described above and increases the reliability and service life of the automatic attending device by optimizing the speed of the attending operation regardless of the textile-technological parameters of the spinning process.

DESCRIPTION OF THE PREFERRED EMBODIMENTS

Figure 1:
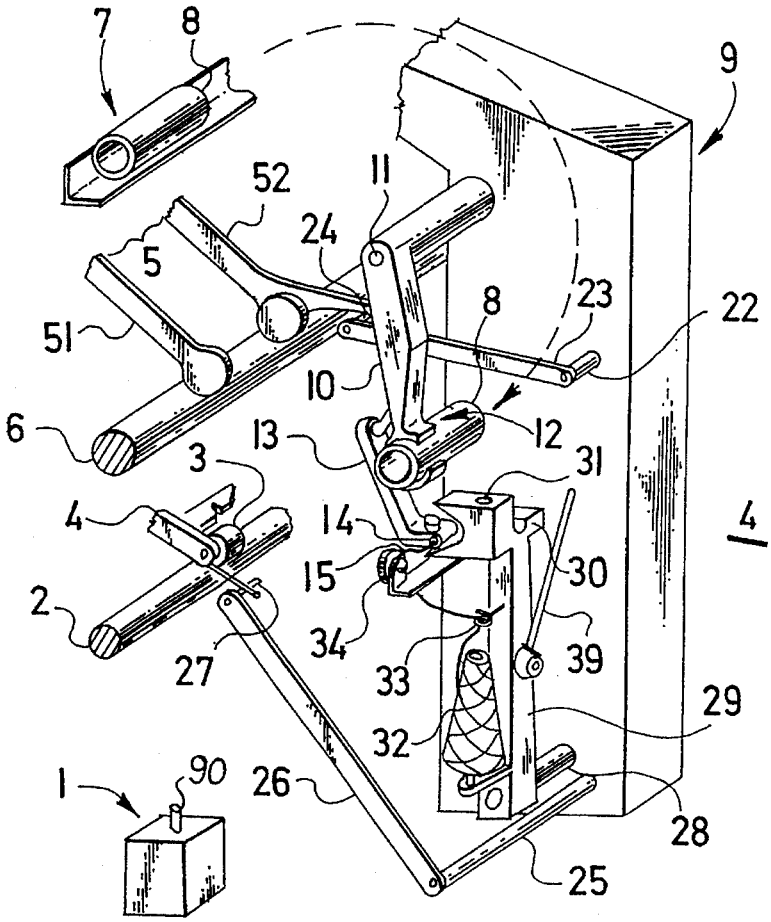
FIG. 1 is a partial perspective view of an attending device according to the present invention.
Figure 2:
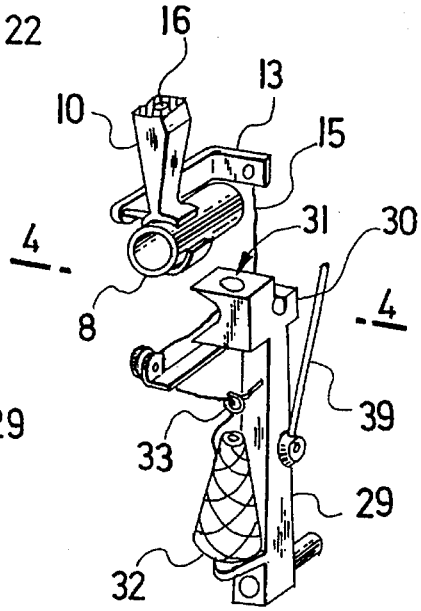
FIG. 2 is a partial perspective view of a spinning-in lever of the device of FIG. 1.

An open-end spinning machine comprises a plurality of operation units arranged side by side, each of which is an independent unit producing yarn from a sliver and winding it on a cross bobbin or cone. FIG. 1 illustrates that the operation unit comprises a spinning unit 1 and a yarn delivery device consisting of a delivery roller 2 and a pressure roller 3 rotatably mounted on a swinging lever 4 and in a known manner pushed into contact with the deliver roller 2. The spun yarn is led from the yarn delivery device into a winding device comprising a bobbin holder 5 and a winding roller 6. The winding roller 6 is pushed into contact with a bobbin 8 mounted in the bobbin holder 5. A receiving station 7 is positioned near the bobbin holder. The receiving station 7 holds an empty tube 8 awaiting transportation of the operation cycle of an attending device 9.

Arranged alongside the row of the operation units is a transport rail, which is not shown, for the attending device 9. The attending device 9 has a control system for controlling various functions of the attending device such as the drives of the operating mechanisms of the attending device.

Figure 3:
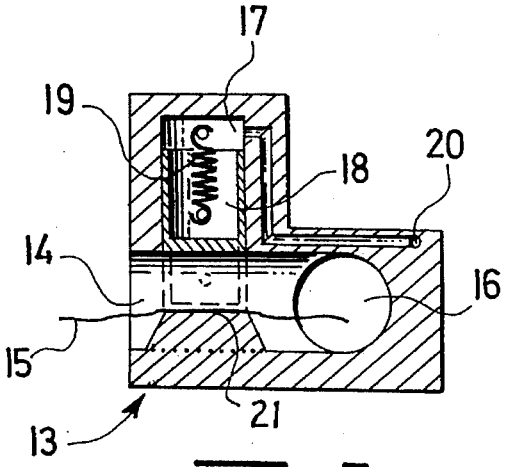
FIG. 3 is a cross-section view of a swinging arm of the device of FIG. 1.

One of these operating mechanisms of the attending device 9 is a device for inserting the empty tube 8 into the bobbin holder 5, consisting of a transport 10 for inserting the empty tube 8 between holder swinging arms 51, 52 of the bobbin holder 5. The transport arm 10 is mounted rotatably around an axis 11 on the body of the attending device 9. At the extremity of the transport arm 10 are mounted a gripping device 12 for grasping empty tube 8 and a swinging arm 13 rotatably mounted to transport arm 10. Swinging arm 13 is fitted at its end with a suction hole 14 for taking up or sucking in ancillary yarn 15. The suction hole 14 is connected with a suction channel 16 in the swinging arm 13 and in the transport arm 10 as shown in FIG. 3. Suction is provided by an underpressure source situated in the attending device 9.

A cavity 17 is provided in the swinging arm 13, perpendicular to the suction hole 14. Inside the cavity 17 is mounted a shifting clamp 18 connected to one end of an extension spring 19. An opposite end of spring 19 is fixed to the body of the swinging arm 13. Clamp 18 is a piston which moves within the cavity 17. Near the bottom of the cavity 17 is the mouth of a control channel 20 provided in the body of the swinging arm 13 and connected to a pressure air source such as an electropneumatic valve actuated by the control system of the attending device 9.

Opposite the front of the clamp 18, the suction hole 14 has a contact surface 21 for the clamp 18 in which the ancillary yarn 15, sucked into the suction hole 14, is gripped between the clamp 18 and the contact surface 21 of the hole 14.

Figure 5:
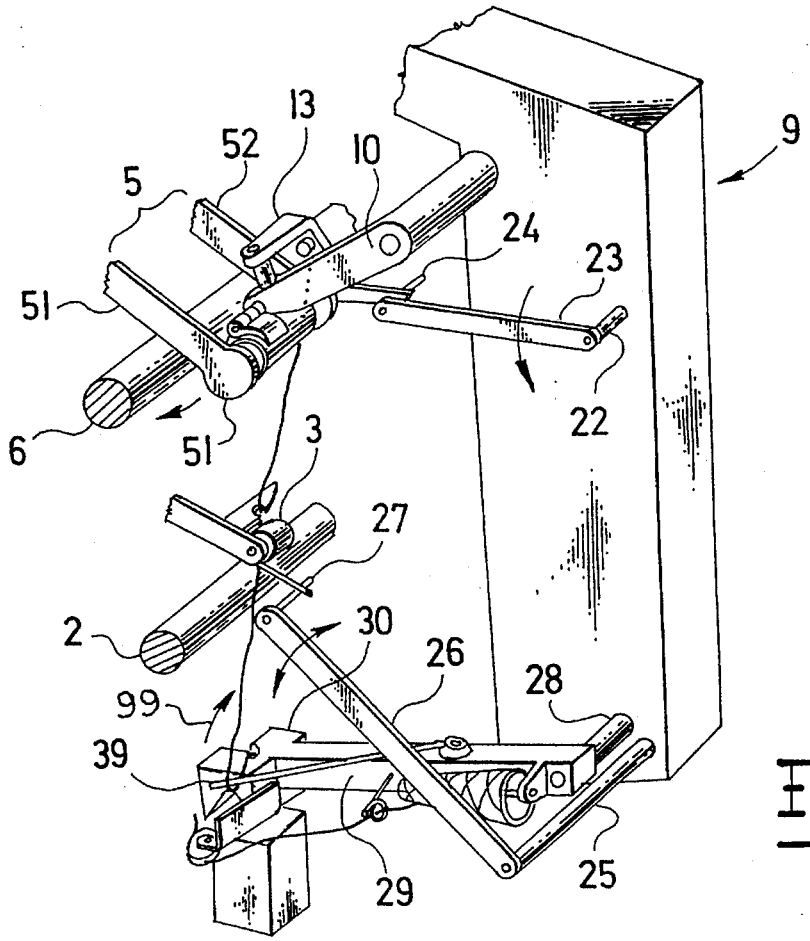
FIG. 5 is a partial perspective view of the device of FIG. 1 in an intermediate position in the spinning-in of the ancillary yarn.

FIGS. 1 and 5 illustrate that the attending device 9 has a swinging mechanism operatively engageable with the swinging arms 51, 52 of the bobbin holder 5 which is used for opening swinging arms 51, 52. The swinging mechanisms comprises a tilting shaft 22 rotatably mounted to the body of the attending device 9 and adapted to move axially therein. A tilting lever 23 is fixed to the tilting shaft 22. A free end of lever 23 has a pin 24 connected with the swinging arm 52 of the bobbin holder 4 so that as the tilting shaft 22 turns, the tilting lever 23 transmits the motion of the tilting shaft 22 to the swinging arms 51, 52 of the bobbin holder 5.

In the lower part of the attending device 9 is rotatably mounted a second tilting shaft 25. A second tilting lever 26 is fixed to shaft 25 at one end. Titling element 27 is fixed to lever 26 at an opposite end. Tilting element 27 engages a swinging lever 4 carrying a pressure roller 3 when the second tilting shaft 25 turns.

In some machines, the yarn being spun-in is inserted between the delivery and pressure rollers while they maintain their mutual distance without increasing it. In these machines no lever is provided. In the attending device 9, there is also mounted a spinning-in device consisting of a rotatably mounted spinning-in shaft 28 to which is fixed a spinning-in lever 29 carrying on its free end a spinning-in head 30 in which is situated an ancillary yarn end producing device 31 for producing the ancillary yarn end and for giving the end a shape suitable to be spun-in.

A reserve bobbin 32 is mounted in the lower part of the spinning-in lever 29 so that the ancillary yarn 15 is led from the bobbin 32 through a guiding eye 33 provided on lever 29 and into a means for holding the beginning of the ancillary yarn 15, e.g. a yarn brake 34.

The position of the reserve bobbin 32 and of the yarn brake 34 is not essential for the functioning of the present invention but the beginning of the ancillary yarn 15 must lie in, or near to, the area of the end position of the swinging arm 13 opposite the suction hole 14 so that it can be sucked into suction channel 16. In other words, both the reserve bobbin 32 and the yarn brake 34 can be mounted directly on the frame of the attending device 9, but of course in a position adequate to accommodate the required function.

Figure 7:
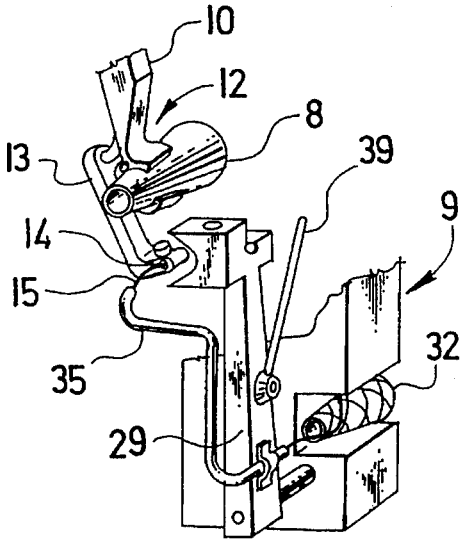
FIG. 7 is a third embodiment of the device of FIG. 1.

FIG. 7 illustrates another embodiment of the present invention in that the guiding eyes 33 and the yarn brake 34 are replaced by a guiding pipe 35 whose end is situated in the area of the end position of the swinging arm 13 opposite the suction hole 14 or in its vicinity. In another embodiment, the guiding pipe 35 can be replaced by a hose.

Figure 4:
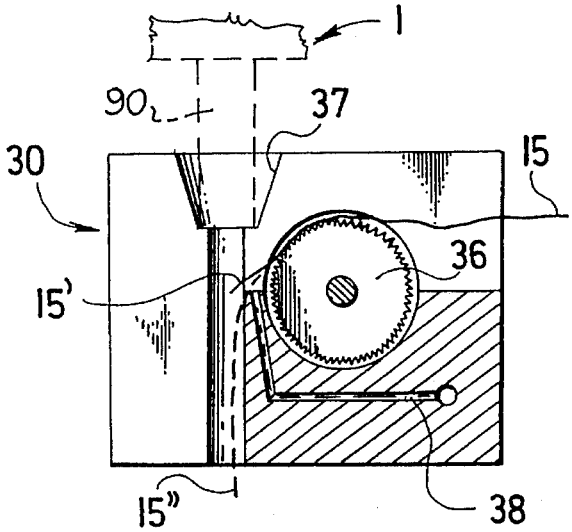
FIG. 4 is a cross-section view of a spinning-in head of the lever of FIG. 2 taken along line 4—4.

FIG. 4 shows that the ancillary yarn end producing device 31 for producing the ancillary yarn end and for shaping it suitably to be spun-in consists of a tearing disc 36 mounted within spinning-in head 30. In this embodiment, the spinning-in head 30 comprises a draw-in cone 37 oriented in a spinning-in position for receiving the end of a delivery tube 90 of the spinning unit 1. In a preferred embodiment, the spinning-in head 30 comprises an ancillary channel 38 of pressure air having at its end a nozzle directed in the spinning-in position into the delivery tube of the spinning unit 1.

An ancillary lever 39 is rotatably mounted on the spinning-in lever 29.

Figure 6:
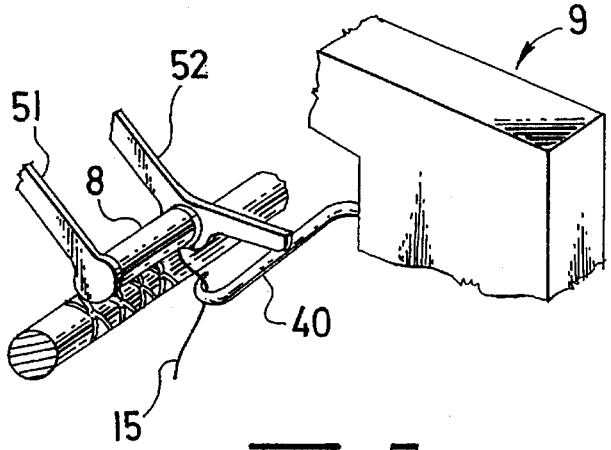
FIG. 6 is a second embodiment of the device of FIG. 1.

FIG. 6 shows that in the upper part of the attending device 9 is mounted a tilting stop 40 for holding the yarn 15 at the edge of the tube 8 for producing the reserve yarn.

FIGS. 1, 2, 5, and 6 show the various stages of the insertion of the ancillary yarn 15 onto the tube 8.

In the gripping device 12 of the transport arm 10 is fixed the empty tube 8 which is taken from the receiving station 7 at the end of the preceding operation cycle of the attending device 9. The swinging arm 13 is positioned in a transport position so that the suction hole 14 is next to the front of the tube 8. The swinging arm 10 swings in the direction of the dashed arrow shown in FIG. 1 to an intermediate position of the ancillary yarn 15 so that the suction hole 14 lies opposite the mechanism for holding the ancillary yarn 15, i.e., either a yarn brake 34 or a guiding pipe 35. In the gripping position of the swinging arm 13, the beginning of the ancillary yarn 15 is sucked into the suction hole 14 and into the suction channel 16 of the swinging arm 13. When the ancillary yarn 15 has been sucked into the suction channel 16, pressure air is supplied through the control channel 20 into the cavity 17 thus pushing the clamp 18 into contact with the contact surface 21 of the suction hole 14 thus gripping the ancillary yarn 15.

When the ancillary yarn 15 has been gripped by the clamp 18, the spinning-in head 30 moves and is positioned so as to lie over the spinning unit 1 and the ancillary yarn 15 engages the tearing disc 36, as shown in FIG. 4. The draw-in cone 37 engages the end of the delivery tube 90 of the spinning unit 1.

The attending device 9 turns the tilting shaft 22 with the tilting lever 23 thus bringing the pin 24 into contact with the length of the swinging arm 52 of the bobbin holder 5 and then lifting the holder 5 to a delivering position. The axial displacement of the tilting shaft 22 is transmitted via the tilting lever 23 to the lengthened part of the swinging arm 52 thus opening the swinging arms 51, 52 of the bobbin holder 5. The transport arm 10 transporting the tube 8 swings between the opened swinging arms 51, 52. At the same time, the swinging arm 13 swings back to the delivering position placing the ancillary yarn 15 next to the front of the tube 8. At the moment when the tube arrives between the opened swinging arms 51, 52 of the bobbin holder 5, the ancillary yarn 15 lies between the front of the tube 8 and the related swinging arm 52. During the reverse axial movement of the tilting shaft 22, the ancillary yarn 15 is gripped between the front of the tube 8 and the swinging arm 52.

The swinging movement of the ancillary lever 39 meters out a spinning reserve of a predetermined length of the ancillary yarn 15. Since the second tilting lever 26 has displaced the pressure roller 3 and thus created a gap between it and the delivery roller 2, the ancillary yarn 15 is inserted between rollers 2 and 3. The length of ancillary yarn 15 required for this operation is unwound from the reserve bobbin 32.

The ancillary yarn 15 is then interrupted by cutting by the tearing disc 36, and its end is given a shape suitable for spinning-in as shown in FIG. 5. FIG. 4 shows that the beginning 15" of the ancillary yarn 15 for the further operation is shown by the dashed line. This beginning 15" of the ancillary yarn 15 remains in the yarn brake 34 or in the guiding pipe 35 ready to be sucked in during the next cycle.

An end 15' of the ancillary yarn 15 is sucked into the delivery tube 90 of the spinning unit 1. To support the introduction of the end 15' of the ancillary yarn 15 into the delivery tube of the spinning unit 1, it is best to use pressure air coming through the ancillary channel 38 to a suitably oriented nozzle. The spinning-in reserve or metered length of the ancillary yarn 15 in direction 99 is shown in FIG. 5. The ancillary yarn 15 is then in contact with the pressure roller and the delivery roller 2 on the one hand, and the tube 8 fixed in the bobbin holder 5 with the winding roller 6 on the other hand so that the yarn delivery can begin. The fiber feed into the spinning unit 1 as well as the other operations taking place in the spinning process are controlled in a known manner and is not described in more detail because it is irrelevant to the principle of this invention.

When the spinning-in is finished, the yarn from the spinning unit is held at the edge of the tube 8 as shown in FIG. 6 by means of the tilting stop 40 so that into the yarn reserve is wound first the ancillary yarn 15 which can be set apart from the yarn being produced, for instance, by its colour in order to be easily identified from the newly produced yarn in the further processing. The end of the ancillary yarn 15 is only about 0.5 m long and can be easily removed for the further use of the bobbins. When the yarn reserve has been created, the tilting stop 40 tilts off and the yarn is handed over to the machine for further distribution. This begins the cross winding. The respinning-in is finished by taking an empty tube 8 from the receiving station 7 by means of the gripping device 12 of the transport arm 10. The empty tube 8 is in the gripping device 12 ready for the next operating cycle of the attending device.

At the beginning of the operating cycle at a new operation unit, the control system of the attending device sends an instruction for transporting the empty tube 8 to the operation unit in question. Consequently, the tube 8 is ready at the receiving station 7 at the end of an operation cycle of the attending device 9.

We claim:

1. A method of respinning using an attending device on an operating unit of an open-end spinning machine having a spinning unit, after replacement of a full bobbin by an empty tube using, for respinning, an ancillary yarn from an ancillary yarn unwinding means mounted on the attending device, the ancillary yarn having a beginning and the operating unit having a winding device for winding yarn on an empty tube, the method comprising the steps, in sequence, of:

displacing the beginning of said ancillary yarn toward the winding device;

fixing the beginning of said ancillary yarn at a point in said winding device for winding on an empty tube at a location on the tube for enabling removal of the ancillary yarn winding from the empty tube before a completion of respinning on the tube;

metering a predetermined length of the ancillary yarn from the point of its fixing in the winding device, by unwinding the ancillary yarn from the unwinding means, the ancillary yarn being led from the point of its fixing in the winding device in the direction of the spinning unit;

at the latest after the above steps have been carried out, inserting an empty tube into the winding device and fixing the ancillary yarn to the tube;

after the above steps have been carried out, severing the ancillary yarn at a further point established by the metering of said predetermined length of the ancillary yarn between said fixing point of the ancillary yarn in the winding device and the unwinding means of the ancillary yarn, thus creating a spinning-in end of the ancillary yarn and at the same time also a new beginning of the ancillary yarn situated on the unwinding means of the ancillary yarn, while the empty tube in the winding device contains no turns of ancillary yarn because the tube has not yet begun to rotate, with the empty tube in a stopped state;

moving the created spinning-in end of the ancillary yarn into the spinning unit for respinning, the first mentioned beginning of the ancillary yarn being fixed on the tube in the winding device; and resuming a spinning connected with the beginning of the yarn winding on the tube in the winding device, before this time, no ancillary yarn having been wound on the tube.

2. A method as claimed in claim 1, in which there is provided on the attending device a displacing means for grasping the ancillary yarn and displacing it for fixing into the winding device.

3. A method as claimed in claim 2, in which the beginning of the ancillary yarn is displaced simultaneously with the empty tube.

4. A method as claimed in claim 3, in which the empty tube, after being displaced together with the beginning of the ancillary yarn, is positioned between open bobbin arms, a front end of the ancillary yarn lying behind the tube next to one of its flanges so that the ancillary yarn passes between the flange of the empty tube and the opened, tilted away bobbin arm and upon tilting of the bobbin arm toward the tube flange, becomes gripped between said tube flange and said bobbin arm and its beginning is released from the displacing means whereby the ancillary yarn is fixed for winding in the winding device.

* * * * *